US010900753B1

(12) United States Patent
Nicholas et al.

(10) Patent No.: US 10,900,753 B1
(45) Date of Patent: Jan. 26, 2021

(54) CANINE PROTECTION SYSTEMS AND RELATED METHODS

(71) Applicant: Skool Dogs Inc, McDonald, PA (US)

(72) Inventors: Joseph Nicholas, Monroeville, NJ (US); Brandon Womack, Windermere, FL (US)

(73) Assignee: Skool Dogs Inc., McDonald, PA (US)

( * ) Notice: Subject to any disclaimer, the term of this patent is extended or adjusted under 35 U.S.C. 154(b) by 18 days.

(21) Appl. No.: 16/005,530

(22) Filed: Jun. 11, 2018

(51) Int. Cl.
*F41H 13/00* (2006.01)

(52) U.S. Cl.
CPC ..... *F41H 13/00* (2013.01)

(58) Field of Classification Search
CPC ..... F41H 13/00; F41H 11/132; A01K 29/005; Y10S 119/905
USPC ..... 89/1.11; 119/712
See application file for complete search history.

(56) References Cited

U.S. PATENT DOCUMENTS 8,931,327 B2 * 1/2015 Pearce ..... F41H 13/00 73/23.34
8,959,982 B2 * 2/2015 Pearce ..... F41H 11/132 73/23.34
9,080,886 B1 * 7/2015 Lacaze ..... G08B 1/08
9,372,088 B2 * 6/2016 Lacaze ..... G01S 19/45
9,763,426 B2 * 9/2017 Pearce ..... A01K 27/003
2008/0163671 A1 * 7/2008 Dugan ..... G01N 33/0073 73/23.34
2009/0145369 A1 * 6/2009 Lumbroso ..... A01K 15/02 119/421
2012/0111285 A1 * 5/2012 Pearce ..... G01N 33/0001 119/712
2014/0070944 A1 * 3/2014 Lacaze ..... G01C 21/28 340/539.13
2014/0102380 A1 * 4/2014 Pearce ..... A01K 27/003 119/712
2015/0090194 A1 * 4/2015 Pearce ..... A01K 15/00 119/712
2015/0185025 A1 * 7/2015 Lacaze ..... G01C 21/28 701/451
2016/0316718 A1 * 11/2016 Pearce ..... G01N 33/0001
2016/0371940 A1 * 12/2016 Lacaze ..... G01S 19/47
2018/0007866 A1 * 1/2018 Pearce ..... F41H 11/132
2018/0245890 A1 * 8/2018 Allen ..... G06N 5/022

OTHER PUBLICATIONS

Adrienne Maloff, "Specially trained K-9s could prevent school shootings", Mar. 13, 2018, sun-sentinel.com, http://www.sun-sentinel.com/opinion/commentary/fl-op-trained-dogs-school-shooting-prevention-20180313-story.html, pp. 1-3 (Year: 2018).*

(Continued)

*Primary Examiner* — Joshua E Freeman
*Assistant Examiner* — Bridget A Cochran
(74) *Attorney, Agent, or Firm* — Adam R. Stephenson, Ltd.

(57) ABSTRACT

Implementations of methods may be used for detecting firearms and ammunition in a school building, the methods may include: introducing a canine into a school building and providing access for the canine to smell one or more of a floor, a plurality of cabinets, or a plurality of bags in the school building. The method may also include observing an action of the canine sitting in a vicinity of an object that the canine has detected as containing one of gunpowder and ammunition.

16 Claims, 4 Drawing Sheets

(56) References Cited

OTHER PUBLICATIONS

Sergeant Bill Lewis II, "One of the newest trends is the use of a well-trained K-9 partner to detect firearms", Jan. 3, 2012, policeone.com, https://www.policeone.com/police-products/firearms/articles/3468167-Gun-Dogs-The-rise-of-firearms-sniffing-K-9s/, pp. 1-4 (Year: 2012).*

Linda Cole, "Can Dogs Detect Gunpowder?", May 13, 2018, wagwalking.com, https://wagwalking.com/sense/can-dogs-detect-gunpowder, pp. 1-7 (Year: 2018).*

* cited by examiner

CANINE PROTECTION SYSTEMS AND RELATED METHODS

BACKGROUND

1. Technical Field

Aspects of this document relate generally to using trained canines in surveying populated areas.

2. Background

Buildings are often protected using armed security guards and/or metal detectors to screen for dangerous objects like guns. Security systems are also employed which may be monitored remotely to allow individuals to see the nature of activities taking place in and around the building. Alarm systems generally work through passively monitoring various sensors and sounding alarms in response to signals received through the sensors.

SUMMARY

Implementations of a method of detecting firearms and ammunition in a school building may include: introducing a canine into a school building and providing access for the canine to smell one or more of a floor, a plurality of cabinets, or a plurality of bags in the school building. The method may also include observing the action of the canine sitting in a vicinity of an object that the canine has detected as containing one of gunpowder and ammunition.

Implementations of methods for detecting firearms and ammunition in a school building may include one, all, or any of the following:

The vicinity may be a three foot radius of a gunpowder scent.

The canine may be trained to detect one of four different scents as the gunpowder scent.

The method may further include using the canine to continuously listen for one or more gunshots in the school building.

The method may further include signaling a location of the one or more gunshots through having the canine run toward a perceived location of the one or more gunshots.

The method may further include distracting a person firing the one or more gunshots through having the canine run at the person.

Implementations of methods of intervening in a school shooting may include: introducing a canine to a school building. The method may include signaling a location of one or more gunshots through having the canine run toward a perceived location of the one or more gunshots. The method may also include allowing the canine to distract a person holding a gun after firing one or more gunshots and allowing one or more individuals in the vicinity to escape the person holding the gun after firing one or more gunshots through the canine distracting the person.

Implementations of methods for detecting firearms and ammunition in a school building may include one, all, or any of the following:

Distracting the person holding the gun may involve playing with the person holding the gun, running around the person holding the gun, or grabbing an arm of the person holding the gun.

The canine may be trained to detect one of four different scents as a gunpowder scent.

The method may further include the canine sitting in a vicinity of an object that the canine detects as containing one of gunpowder and ammunition.

The vicinity may be a three foot radius of a gunpowder scent.

Signaling by the canine proceeding towards the sound of one or more gunshots may include a handler being pulled by the canine on a leash.

The canine may not be a trained police dog, a trained drug dog, a trained bomb dog, and a trained military dog.

Implementations of methods for detecting firearms and ammunition and intervening in a shooting in a school building may include: introducing a canine to a school building and permitting the canine to detect gunpowder and ammunition through smell by allowing the canine to smell a floor, a plurality of cabinets, or a plurality of bags in the school building. The method may include signaling a location of one or more gunshots through having the canine run toward a perceived location of the one or more gunshots. The method may include allowing the canine to distract a person holding a gun after firing one or more gunshots and allowing one or more individuals in the vicinity to escape the person firing one or more gunshots through the canine distracting the person. The method may also include allowing a handler of the canine to engage the person firing the one or more gunshots through signaling by the canine.

Implementations of methods for detecting firearms and ammunition in a school building may include one, all, or any of the following:

Allowing the canine to distract the person holding the gun may involve one of playing with the person holding the gun, running around the person holding the gun, or grabbing an arm of the person holding the gun.

The canine may be capable of smelling a gunpowder scent within a vicinity of a three foot radius of a gunpowder scent.

The gunpowder scent may be one of four scents.

The canine proceeding towards the sound of one or more gunshots may include a handler being pulled by the canine on a leash.

Allowing a handler of the canine to engage the person firing the one or more gunshots may include using a firearm.

The canine may not be a trained police dog, a trained drug dog, a trained bomb dog, and a trained military dog.

The foregoing and other aspects, features, and advantages will be apparent to those artisans of ordinary skill in the art from the DESCRIPTION and DRAWINGS, and from the CLAIMS.

BRIEF DESCRIPTION OF THE DRAWINGS

Implementations will hereinafter be described in conjunction with the appended drawings, where like designations denote like elements, and.

DESCRIPTION

This disclosure, its aspects and implementations, are not limited to the specific components, assembly procedures or method elements disclosed herein. Many additional components, assembly procedures and/or method elements known in the art consistent with the intended school protection systems and related methods will become apparent for use with particular implementations from this disclosure. Accordingly, for example, although particular implementations are disclosed, such implementations and implementing components may comprise any shape, size, style, type, model, version, measurement, concentration, material, quantity, method element, step, and/or the like as is known in the art for such school protection systems and related methods, and implementing components and methods, consistent with the intended operation and methods.

Protecting students in school buildings from persons having guns, ammunition, and firearms is challenging. Some schools have school resource police officers on campus that have a firearm and can call in backup if a person having a gun starts shooting on campus. The person on campus with a gun may be a community member, a student, other people known to the school officials, or a stranger unknown to anyone at the campus of the school building. Unfortunately, on campus police officers are not available in all schools in all communities. There have been various proposals raised to allow teachers to carry firearms allowing them to stop an armed gunman. However, teachers have expressed discomfort with that added level of responsibility to train and maintain firearm proficiency. Human based solutions to oppose school shooters depend on a person's desire and ability to engage the shooter and rely on human speed to reach the shooter.

Implementations of various methods disclosed in this document may help prevent and stop school shootings in progress with lower human casualties through training and utilizing a canine trained to proactively detect ammunition and firearms through smell. In the event of an active shooter situation, the canine may also be trained to respond to the sounds of gunshots and engage the person holding the gun thereby intervening in the school shooting, allowing those around the shooter to escape, and possibly saving many lives.

Figure 1:
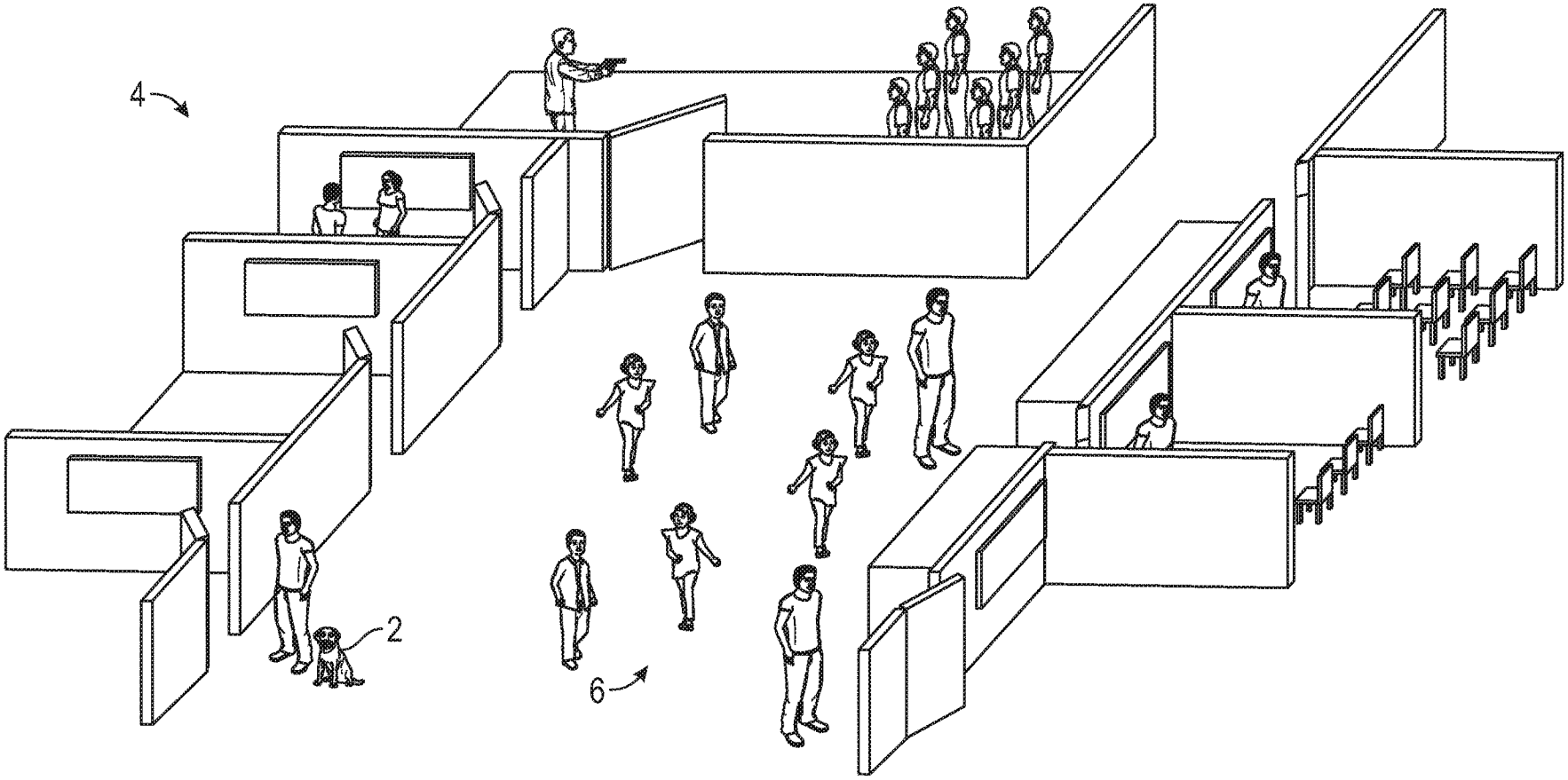
FIG. 1 is a schematic of an interior of a school building with ceiling and wall areas removed.

Referring to FIG. 1, in various implementations of methods of protecting a building, such as a school, a canine 2 may be trained to smell ammunition and/or a firearm located in a school building 4 or other school like environment. A canine 2 having such training would need to be comfortable around large groups 6 of people, especially children. Such canines may undergo four phases of a training regimen. The first phase may include basic canine obedience training such as sit, come, down, stay, leave it and other essential commands. After completing obedience training, the second phase involves training the canine to be comfortable in its working environment, such as the building(s) it will be patrolling (such as a school). By non-limiting example, in this phase the canine 2 may be trained to be accustomed with loud noises such as school bells, children running and making noises, books falling, and other noises associated with school buildings. The canine 2 will also be trained to be accustomed to the environment around the outside of the school in the school yard. By non-limiting example, the canine may be trained to be comfortable with school buses and a high quantity of school buses where some schools can have a flow of 50 or more buses in a day including when special events occur at the school building.

Referring again to FIG. 1, the canines 2 trained for use in the methods disclosed herein during the second phase of training would be trained to be friendly with children in an everyday school environment. In various implementations, the training of the second phase would take place in the school environment where the canine will be working in order to accustom the canine with slippery floors such as by non-limiting example, linolinuem, tile, wood, or other industrial surfaces used in school buildings. In some implementations, the canines would also be trained to be accustomed on stairs and elevators. By the end of the second phase of training, the canine will have become accustomed to and will know the layout of the various buildings and areas in which the canine will actuall be working.

In various implementations, the breeds of canines to be used in school protection systems would be a German Shepherd or a Belgian Malinois. In other implementations, other breeds that can be trained to perform the tasks associated with the various methods implementations disclosed herein may be used. The canines used in implementations of school protection systems need to be good with people in general and so those canines coming from an abusive background such as rescue dogs may not be suitable for use in the various method implementations.

Figure 3:
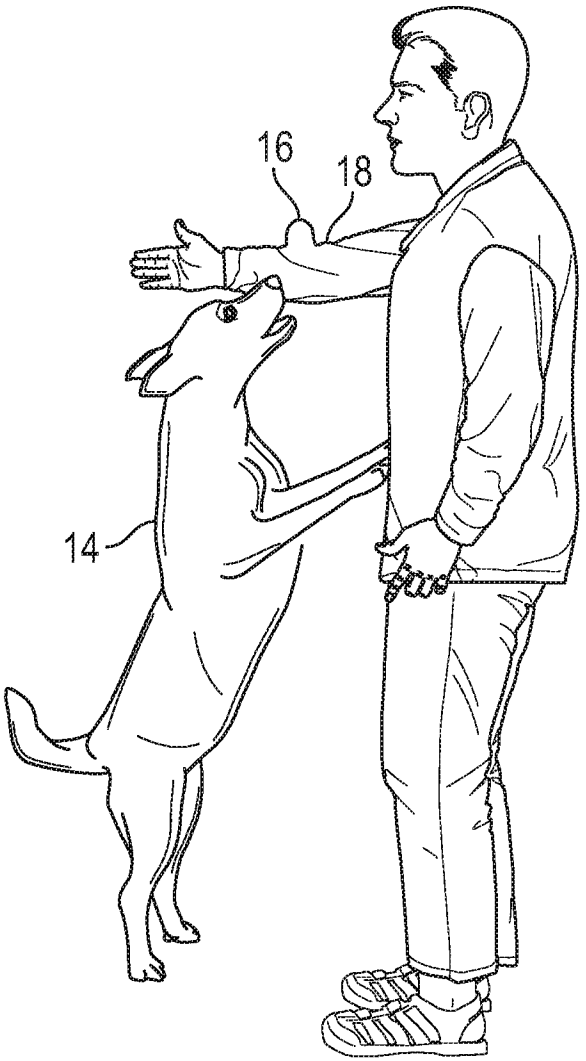
FIG. 3 is a side view of a training scenario involving a canine using a toy.
Figure 2:
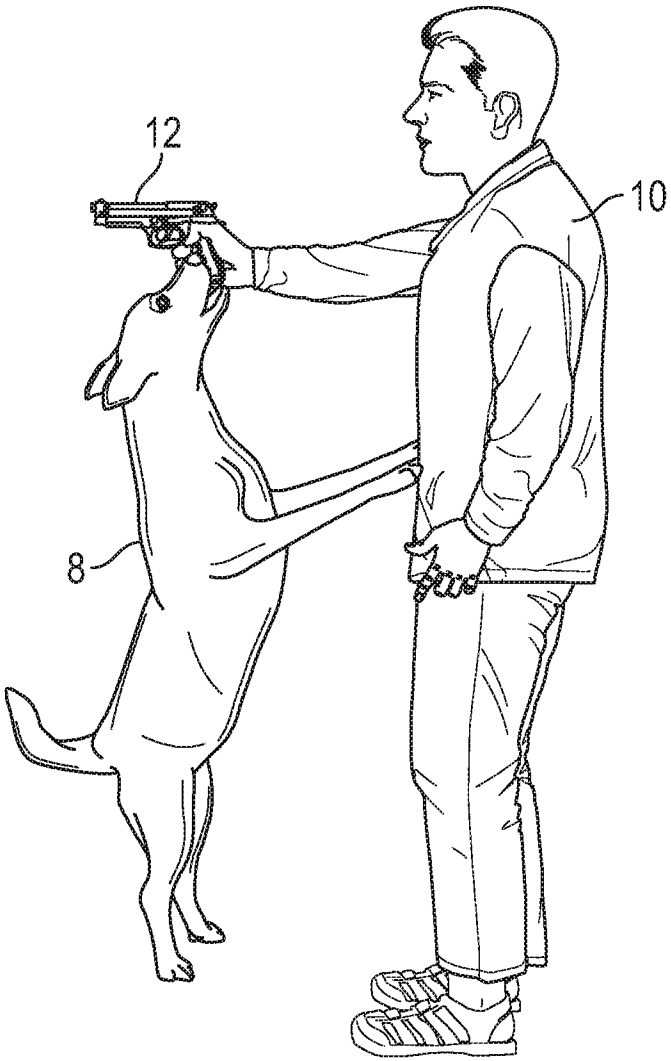
FIG. 2 is a side view of a training scenario involving a canine using a firearm.

In the third phase of training, the canine is trained to respond specifically to the sound of gunfire and to signal its handler by moving toward the sound of gunfire. This phase of training is completely unlike how other canines, such as police, drug, bomb, and military dogs, are trained. Police, drug, bomb, and military dogs are taught to avoid contact with a person shooting a weapon as a survival method and not to respond or signal specifically to the sound of a gunshot. This third phase of training is used to overcome a canine's general apprehensiveness around loud sounds such as gunshots, and the like and to teach the canine that the sound of the gunshot is an invitation. In various implementations of methods disclosed herein, the canines are trained to associate the sound of a gunshot with its toy—the sound of the gunshot signals having fun. For example, the canine is introduced to the toy, and then the toy is given to a person holding the weapon, who then fires a gun. The dog then runs toward a perceived location of the gunshot to try to get a toy from the person making the sound. Referring to FIG. 2, the result of the training is that the canine 8 engages the person 10 holding the gun 12 after the gun is fired because the gunshot identifies the person 10 who is holding the dog's toy. Because the toy is associated with the gun hand of the person 10, the dog engages the gun hand of the person 10, believing the toy is there. Referring to FIG. 3, in various versions of the third phase of training, the canine 14 may be trained by placing a toy 16 under the sleeve 18 of the gun hand of the person 10. Because of this, the dog is taught to engage the sleeve 18 after the gunshot has been fired, looking for the toy. This has the effect in an active shooting situation of throwing the shooter off, as the canine arrives on the scene and immediately engages the gun hand of the shooter, distracting and potentially preventing the shooter from being able to fire more shots.

During the third phase of training, the canine learns to associate a person holding a firearm as someone to play with. Because the training method involves play, the canine does not associate its work with fear or pain, meaning that the canine will be happy while it is working, which is important when the canine is constantly surrounded by children of various ages. During the third phase of training the canine is not taught specifically to bite the person with the person holding the gun. Instead the canine will be trained that a person who has just fired a gun wants to play with the canine as illustrated in FIG. 2. This training means the canine perceives a gunshot as an opportunity to play and not something to fear. This positive method of training the canine to response to a gunshot and engage the person holding the gun increases the desire of the canine to reach the person and engage them as soon as possible. Since the canine can hear better than any human handler, the canine is more likely to respond and to respond sooner and move immediately toward the shooter in the right direction than any human is capable of.

During the third phase of training, training the canine to interact with a person holding a gun may include a progressive process. The canine first be exposed to a sound of a gun firing. By non-limiting example, the training may include starting with firing a .22 caliber gun. When the canine hears the gunshot the canine is then given a toy to tug on. The next step of training may includes the canine being allowed to tug on the shoe of the person holding the toy. In various implementations, the training includes placing the toy on or under the sleeve of the person firing a gun as illustrated in FIG. 3, causing the canine to engage the sleeve of the person, trying to get the toy out from under the sleeve. In various implementations, the toy may be scented like a firearm (gunpowder scents, as disclosed further in this document) and the canine is trained so that this scent is associated with the toy that the dog wants more than anything. In this way, the canine will not hesitate to engage a shooter, as the canine is looking for its toy and does not associate the shooter with any negative experiences. The canine is trained to interact with people holding guns that are known to the canine. This may be particularly helpful since many school shooters are current or former students of the school which they target. Therefore, during the third phase of training, the canine remaining friendly with the person holding the gun is very important to helping the canine engage with the person who has just shot the weapon. Because the canine enters the situation with the shooter wanting to play, the canine effectively distracts the person holding the fired gun rather than attempting to hurt or otherwise take down the person. Training the canine with toys instills a playful environment for the canine rather using a high stress and fearful environment, which means the canine will be relaxed while it is working rather than stressed and anxious, important in a school setting. Also, during the training process guns and firearms will be fired around the canine to further desensitize the canine to the loud noises of gunshots.

In the fourth phase of training, the canine is trained to identify the scents of various types of gunpowders. In particular implementations, the canine may be trained to smell at least four scents specific to various types of gunpowders. In learning the four scents, the canine may be able to then detect the scent of gunpowder in/on ammunition, in firearms, and the scent of gunpowder residue in a firearm that has been fired. In various implementations, the canine will be trained to detect unloaded firearms as well through smelling the scent of the gunpowder in the gun after it has been fired. While the canine may not be able to detect the scent of a never-fired firearm that has no ammunition in it, at the same time, this type of firearm is the least dangerous situation in a school setting, and cannot be fired by a shooter. However, once the weapon has been fired at least once, the residual gunpowder may make the weapon detectable even without being loaded. By non-limiting example, the canine may be trained to find bullets, bullet casings, firearms, and other items associated with gunpowder, ammunition, and firearms that have contacted gunpowder. In this fourth phase of training, the canine does includes training in smelling scents associated with drug dogs which involve learning 7 different scents or bomb dogs which involve learning 31 different scents. Because just 4 scents are involved in this phase of training (such as, by non-limiting example, smokeless gun powder, black powder, gun powder, and gun powder marketed under the tradename PYRODEX by Hodgdon Powder Company of Shawnee, Kans.), this fourth phase of the training is not as involved or take as long as that used for police, drug, bomb, and military dogs.

During this phase of training, a scarf or other material with the scent on it is introduced to the dog, and when the dog encounters that scent, the person holding the scarf plays with the dog if the dog sits down within a three foot radius of the scent. In this way, the canine is not trained to be a "wake dog" where the canine is trained to follow the wake of a scent and actively lead the handler to the location of the scent. Rather, the canine is trained to signal the location of the gunpowder scent by sitting down at the location, which means the canine will not engage any person in the vicinity of the scent. This has the advantage of allowing the signal to the handler to be communicated discreetly, which, if the scent is coming from a stationary individual, allows the handler to engage the person without the person suspecting an issue. Also, where the scent is coming from a stationary location, such as a locker, or backpack on the floor, the dog is able to signal quietly to the handler a search area with a defined radius in which the handler should carry out an investigation even while many people may be moving about in the area.

After the canine has been trained, in various method implementations disclosed herein, as the canine engages the person who has just fired the gun, the person may shoot towards the canine which will waste ammunition, and ensure the gun is not directed at other persons who are trying to flee. This has the effect of potentially saving lives of other people in the school building. The canine will also be trained to run to the person holding the gun even after the person stops shooting the gun. This will allow the canine to grab the arm of the person holding the gun as done during training. While the person holding the gun is distracted by the canine, the handler of the canine or a police officer may then be able to reach the person who has filed the weapon and engage him or her to stop further gunshots entirely. The handler may engage the person holding the gun by firing a handgun at the person holding the gun, employing non-lethal force to the person holding the gun (via a conductive energy weapon, etc.) and/or by making direct physical contact with the person holding the gun. Because the handler can release the canine within a certain distance of the shooter, the canine can reach the shooter faster than the handler. In various implementations, the canine is able to engage the shooter within a period of seconds following a shot, being able to run faster than a handler and move rapidly through crowds of person who may be fleeing the scene. As humans may only be able to reach the shooter within minutes, the ability of the canine to engage sooner reduces, and may significantly reduce, the potential number of persons harmed or killed by the shooter.

As the foregoing training process illustrates, the canines trained for protecting building systems, particularly schools, using the method implementations disclosed in this document are not trained like standard police, drug, bomb, or military dogs. This is because the canines are trained to respond specifically to gunfire and trained to recognize just the scents associated with gunpowder.

Figure 4:
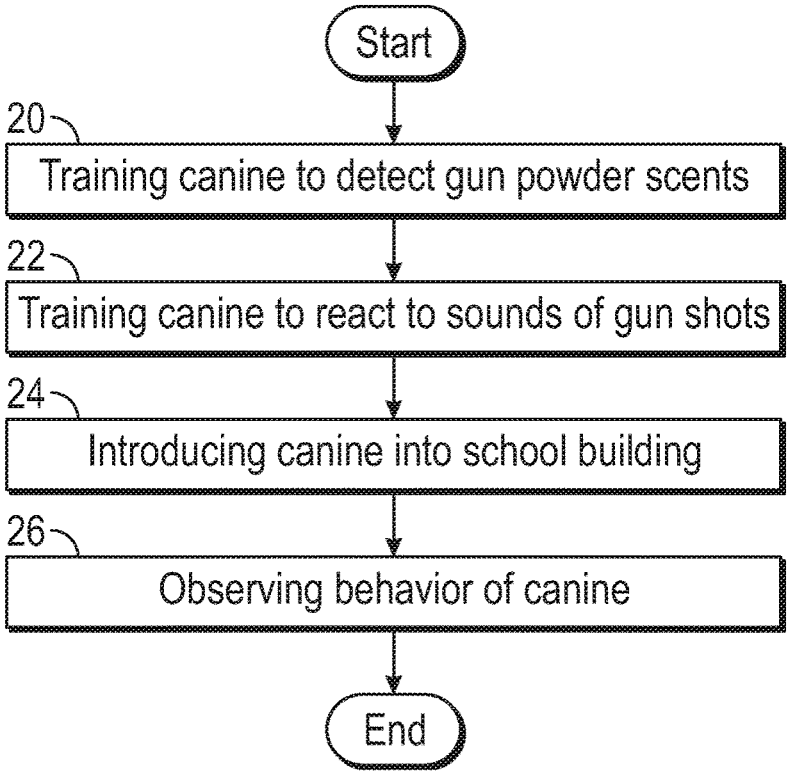
FIG. 4 is a flow chart of an implementation of a method of training a canine and introducing a canine into a school environment.

Referring to FIG. 4, a flowchart illustrates an overview of an implementation of a method of training of a canine to react to the sound of a gunshot. In various implementations, the canine may be trained to detect gunpowder scents (step 20) and also trained to react to sounds of gunshots (step 22) positively using any of the techniques disclosed in this document. After training is completed, the canine is then introduced into a school building (step 24) with a handler to patrol the school building during school hours and the actions of the canine are observed (step 26) by the handler to detect locations and objects having gunpowder scents and also to intervene in school shootings where and when necessary. Because the canine is able to detect and signal when gunpowder is smelled, the canine can proactively be working on its patrol during the entire period of time it is in the school building.

Figure 5:
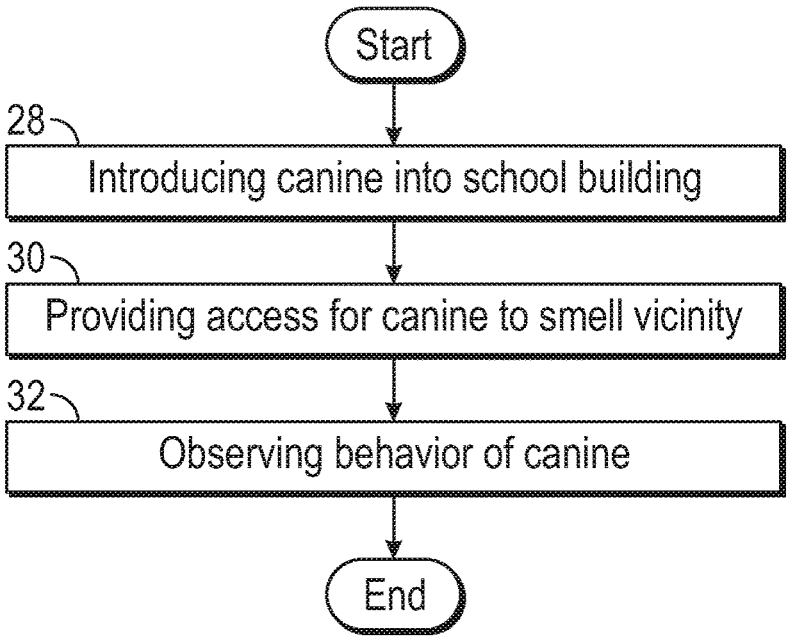
FIG. 5 is a flow chart of an implementation of a method for detecting firearms and ammunition in a school building.

Referring to FIG. 5, a flowchart of a method for detecting firearms and ammunition in a school building using a canine is illustrated. As illustrated, the canine may be introduced into a school building (step 28). The method for detecting firearms and ammunition in a school building may include the canine conducting a search in various implementations. A handler of the canine may provide access for the canine to smell (step 30) various areas of the school building. By non-limiting example, the canine may smell a floor of a school building, a plurality of cabinets and/or a plurality of bags in the school building. In various implementations, the plurality of cabinets may include lockers, storage areas in the school, closets in the school and other areas that may be smaller and closed off from the open area of a school building. The plurality of bags may include, in various implementations, backpacks belonging to the students, purses, sporting bags, and other personal items capable of concealing a firearm or associated ammunition. As previously described the floors may include tile, carpet, stairs, elevators or other surfaces used in the floors of school buildings.

The method may further include a handler observing the actions of the canine (step 32). The actions of the canine may signal to the handler that the canine has detected firearms or ammunition. One action of the canine may include the canine sitting in a vicinity of an object the canine detects as containing gunpowder or ammunition. The vicinity may be about a three foot radius of the location of the gunpowder scent. A three foot radius may allow the handler to notice the signal of the canine without alerting any other individuals in the area including the person that has brought the gunpowder or ammunition. As previously described, the canine is trained to be friendly with the children, students, teachers, and other people at the school. This familiarity may cause the person that has brought the gunpowder or ammunition to be comfortable with the presence of the canine. The person may not notice the action of the canine sitting in a vicinity of an object the canine detects as containing one of gunpowder and ammunition as abnormal. Because the person does not notice the canine signaling the handler the handler may more easily be able to assess the situation fully and act decisively on the signal of the canine without incurring resistance from individuals in the area. While the canine is designed to sit down when detecting the scent and not trail the scent wake of a person moving who is in possession of a firearm and/or ammunition, the handler can cause the dog to get up and follow a person who is moving to see if the dog will sit again, indicating the moving person is potentially carrying firearms and/or ammunition.

Generally, in various method implementations, the canines are trained in the buildings, such as schools, in which they will work. In some method implementations, a canine or group of canines with their handlers may be dedicated to a specific school and work and be trained at that school only. In some method implementations, a canine may be associated with only one handler; in other method implementations, the canine may be associated with more than one handler. In various implementations, multiple canines may be rotated among different buildings, such as schools within a particular area, such as a school district) with either a single handler or multiple handlers. In such implementations, the canine may visit the various campuses on a regular basis to maintain familiarity with a variety of different school building environments. As the assignment of which canine (and which handler) goes to which school campus may be randomly done by day/week or other time period during the school year or other time duration, individuals planning a school shooting may not know which canine and/or which handler will be on duty at any given moment. Also, as the handler's location throughout the campus may be scheduled to follow a random pattern throughout the day, this may further prevent the shooter from relying on any known patterns or routines to try to carry out the shooting when the canine is known to be not in the vicinity.

In various method implementations, the canines receive follow-up training in their buildings (such as school buildings) on a regular basis to keep the skills of the canine sharp. This training may continue throughout the entire year, and not just when school is in session to ensure the canine is ready to work at the beginning of the school year.

Method implementations disclosed herein for detecting firearms and ammunitions in a school building may further include using the canine to continuously listen for one or more gunshots in the school building. Since canines have superior hearing to humans, the canine may be able to hear gunshots in a very large school building and/or campus. In various implementations, the canine may be able to hear the gunshots inside the building when the canine is outside the school building.

Figure 6:
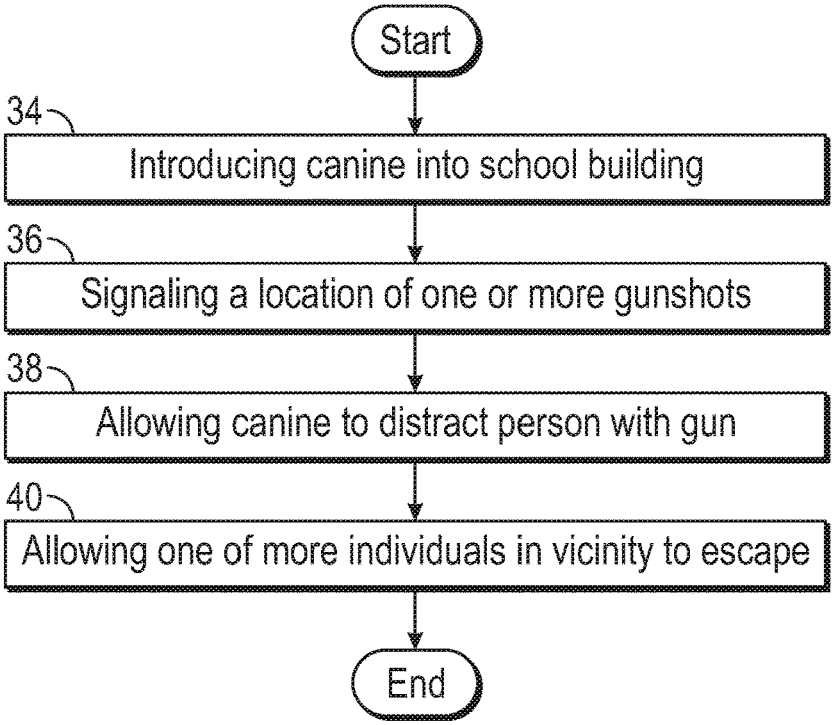
FIG. 6 is a flow chart of an implementation of a method for intervening in a school shooting.

Referring to FIG. 6, a flowchart of a implementation of a method for intervening in a school shooting is illustrated. The method includes introducing a canine to a school building (step 34) and signaling a location of one or more gunshots (step 36). The signaling may include having the canine run towards the perceived location of the one or more gunshots. As previously disclosed in this document, the canine is trained to run towards the location of the sound of the gunshot expecting to play with the person holding the gun. The canine will not be frightened by the sound of the gunshot but will instead be excited by the sound, and want nothing more than to reach the person who fired the shot. As illustrated, the method includes allowing the canine to distract the person holding the gun (step 38) after firing one or more shots. The canine distracting the person holding the gun may allow one or more individuals in the vicinity to escape (step 40) from the range of the person holding the gun. The one or more individuals may escape through leaving an enclosed space, running from the area, entering a safe space, or leaving the building.

In various method implementations described herein, the methods are canine led with the canine on a leash with the handler. The handler is then able to unleash the canine if needed to pursue the sound of a gunshot so the canine can more rapidly reach the shooter.

Figure 7:
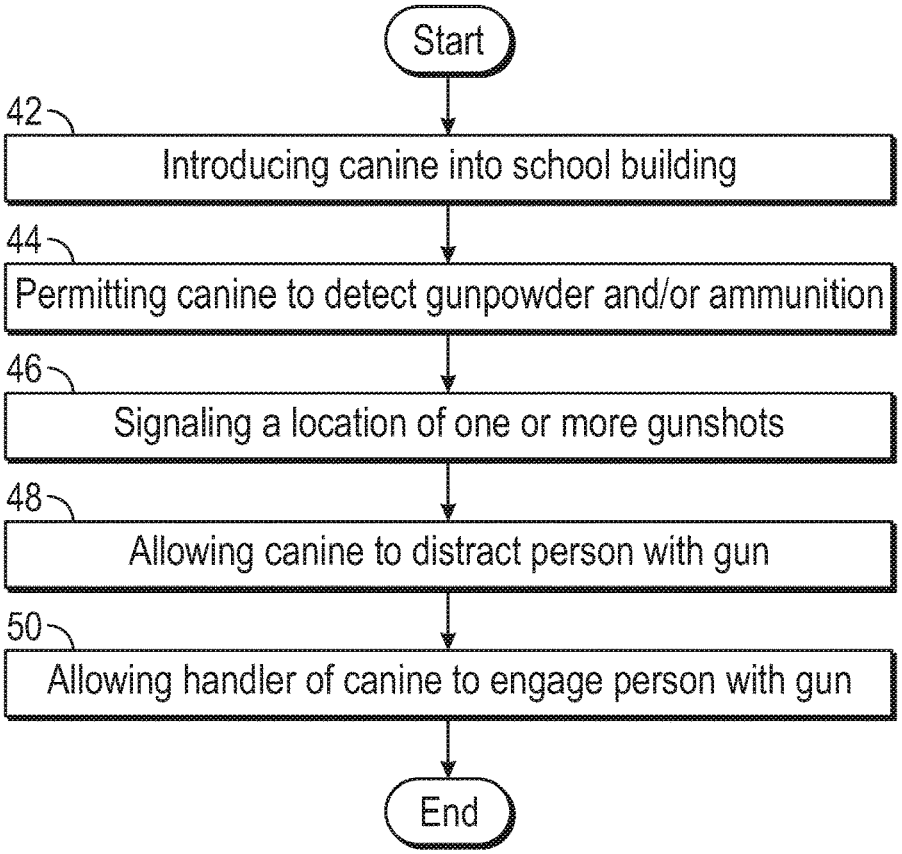
FIG. 7 is a flow chart of an implementation of a method for detecting firearms and ammunition and intervening in a shooting in a school building.

Referring to FIG. 7, a flowchart of an implementation of a method for detecting firearms and ammunition and intervening in a school shooting is illustrated. The method includes introducing a trained canine into a school building (step 42). The canine may be trained to detect gunpowder scents and intervening in school shootings. The method includes permitting the canine to detect gunpowder and ammunition (step 44) through scent by allowing the canine to smell the floors, a plurality of cabinets and a plurality of bags in the school building. By non-limiting example, the plurality of cabinets may also include lockers and closets. The method includes signaling a location of one or more gunshots (step 46) by allowing the canine to run towards a perceived location of the one or more gunshots. The canine may then be allowed to distract the person holding a gun (step 48) thereby allowing one or more individuals in the vicinity to escape the person who fired the one or more gunshots. Once the person holding the gun is distracted, the handler of the canine may be allowed to engage the person (step 50) firing the one or more gunshots through signaling by the canine. By non-limiting example, engaging the person holding the gun may include firing one or more gunshots or any other method of engaging disclosed herein. As previously described, the canine used in various implementations of school protections systems does not have police dog training. The canine is trained differently than a police or military dog because the canine is trained to play with the person holding the gun and to identify just the scents of gunpowder. Because the dog has been training using play, the canine will also be friendly toward the individuals in the vicinity of the school building.

While the various method implementations disclosed in this document disclose the training and use of canines in school buildings and environments to prevent/mitigate shooting events, the principles disclosed herein can be used to train and use canines in method implementations for similarly protecting other types of buildings and environments, such as, by non-limiting example, shopping malls, congested areas, train stations, subway and other public transportation areas, power plants, company campuses, government buildings, stores, resorts, hotels, outdoor/indoor venues, sporting venues, and any other building and/or location type that can be regularly monitored by the canine and a handler.

In places where the description above refers to particular implementations of school protection systems and related methods and implementing components, sub-components, methods and sub-methods, it should be readily apparent that a number of modifications may be made without departing from the spirit thereof and that these implementations, implementing components, sub-components, methods and sub-methods may be applied to other school protection systems.

What is claimed is:

1. A method for intervening in a school shooting, the method comprising:

introducing a canine to a school building;

signaling a location of one or more gunshots through having the canine move toward a perceived location of the one or more gunshots;

allowing the canine to distract a person holding a gun after firing one or more gunshots; and allowing one or more individuals in the vicinity to escape the person holding the gun after firing one or more gunshots through the canine distracting the person;

wherein the canine is not one of a trained police dog, a trained drug dog, a trained bomb dog, or a trained military dog; and wherein the canine signals its handler of the one or more gunshots by moving toward the perceived location of the sound of the one or more gunshots.

2. The method of claim 1, wherein distracting the person holding the gun involves one of playing with the person holding the gun, running around the person holding the gun, and grabbing an arm of the person holding the gun.

3. The method of claim 1, wherein the canine is trained to detect four different scents as a gunpowder scent.

4. The method of claim 3, further comprising the canine sitting in a vicinity of an object which the canine detects as containing one of gunpowder and ammunition.

5. The method of claim 4, wherein the vicinity is a three foot radius of a gunpowder scent.

6. The method of claim 1, wherein signaling by the canine proceeding towards the sound of one or more gunshots further comprises a handler being pulled by the canine on a leash.

7. A method for detecting firearms and ammunition and intervening in a shooting in a school building, the method comprising:

introducing a canine to a school building;

permitting the canine to detect one of gunpowder and ammunition through smell by allowing the canine to smell one or more of a floor, a plurality of cabinets, and a plurality of bags in the school building;

signaling a location of one or more gunshots through having the canine move toward a perceived location of the one or more gunshots;

allowing the canine to distract a person holding a gun after firing one or more gunshots;

allowing one or more individuals in the vicinity to escape the person firing one or more gunshots through the canine distracting the person; and allowing a handler of the canine to engage the person firing the one or more gunshots through signaling by the canine;

wherein the canine is not one of a trained police dog, a trained drug dog, a trained bomb dog, or a trained military dog;

wherein the canine signals its handler of the one or more gunshots by moving toward the perceived location of the sound of the one or more gunshots.

8. The method of claim 7, wherein allowing the canine to distract the person holding the gun involves one of playing with the person holding the gun, running around the person holding the gun, and grabbing an arm of the person holding the gun.

9. The method of claim 7, wherein the canine is capable of smelling a gunpowder scent within a vicinity of a three feet radius of the gunpowder scent.

10. The method of claim 9, wherein the gunpowder scent is one of four scents.

11. The method of claim 7, wherein the canine proceeding towards the sound of one or more gunshots comprises a handler being pulled by the canine on a leash.

12. The method of claim 7, wherein allowing a handler of the canine to engage the person firing the one or more gunshots comprises using a firearm.

13. A method for intervening in a school shooting, the method comprising:

introducing a canine to a school building;

allowing the canine to run towards a location of one or more gunshots through the sound of the one or more gunshots;

allowing the canine to distract a person holding a gun after firing one or more gunshots; and allowing one or more individuals in the vicinity to escape the person holding the gun after firing one or more gunshots through the canine distracting the person;

wherein the canine signals its handler of the one or more gunshots by moving toward the perceived location of the sound of the one or more gunshots;

wherein the canine is not one of a trained police dog, a trained drug dog, a trained bomb dog, or a trained military dog;

wherein the canine remains with the person after the one or more gunshots stop.

14. The method of claim 13, wherein the canine is off a-leash.

15. The method of claim 13, allowing the canine to distract a person holding a gun further comprising the canine grabbing a limb of the person.

16. The method of claim 13, wherein the canine detects one or more gunpowder scents and signals the handler of the location thereof.

* * * * *